US010575561B2

(12) United States Patent
Reevell

(10) Patent No.: US 10,575,561 B2
(45) Date of Patent: Mar. 3, 2020

(54) CARTRIDGE FOR AN AEROSOL-GENERATING SYSTEM WITH CUSTOMIZABLE IDENTIFICATION RESISTANCE

(71) Applicant: Altria Client Services LLC, Richmond, VA (US)

(72) Inventor: Tony Reevell, London (GB)

(73) Assignee: Altria Client Services LLC, Richmond, VA (US)

( * ) Notice: Subject to any disclaimer, the term of this patent is extended or adjusted under 35 U.S.C. 154(b) by 475 days.

(21) Appl. No.: 15/351,855

(22) Filed: Nov. 15, 2016

(65) Prior Publication Data

US 2017/0135405 A1 May 18, 2017

Related U.S. Application Data

(63) Continuation of application No. PCT/EP2016/075861, filed on Oct. 26, 2016.

(30) Foreign Application Priority Data

Nov. 17, 2015 (EP) ..... 15194895

(51) Int. Cl.
*A24F 47/00* (2006.01)
*H01C 7/06* (2006.01)
(Continued)

(52) U.S. Cl.
CPC ..... *A24F 47/008* (2013.01); *H01C 7/06* (2013.01); *H01C 17/24* (2013.01); *H05B 3/44* (2013.01);
(Continued)

(58) Field of Classification Search
CPC ..... A24F 47/008; H01C 17/24; H01C 7/06; H05B 2203/017; H05B 2203/021; H05B 2203/022; H05B 3/44
(Continued)

(56) References Cited

U.S. PATENT DOCUMENTS 5,826,570 A * 10/1998 Goodman ..... A61M 15/00 128/200.14
2004/0252010 A1* 12/2004 Tanaka ..... H01C 17/22 338/309
(Continued)

FOREIGN PATENT DOCUMENTS

EP 2399636 A1 12/2011
EP 2468118 A1 6/2012
(Continued)

OTHER PUBLICATIONS

Extended European Search Report for European Application No. 15194895.7 dated May 18, 2016.
(Continued)

*Primary Examiner* — Tu B Hoang
*Assistant Examiner* — Vy T Nguyen
(74) *Attorney, Agent, or Firm* — Harness, Dickey & Pierce, P.L.C.

(57) ABSTRACT

In a method of manufacturing a cartridge of an electronic vaping device, wherein the cartridge includes a pre-vapor formulation storage element, an electrical resistor is physically manipulated to change a resistance of the electrical resistor from a first resistance value to a second resistance value, the second resistance value indicative of a pre-vapor formulation substrate contained in the pre-vapor formulation storage element. The electrical resistor is then mounted to a portion of the cartridge.

10 Claims, 4 Drawing Sheets

(51) Int. Cl.
*H01C 17/24* (2006.01)
*H05B 3/44* (2006.01)

(52) U.S. Cl.
CPC .. *H05B 2203/017* (2013.01); *H05B 2203/021* (2013.01); *H05B 2203/022* (2013.01)

(58) Field of Classification Search
USPC ..... 392/386; 131/200–300
See application file for complete search history.

(56) References Cited

U.S. PATENT DOCUMENTS

| | | | | |
|---|---|---|---|---|
| 2005/0121495 | A1* | 6/2005 | Yokoyama | B23K 3/0478 228/9 |
| 2007/0159295 | A1* | 7/2007 | Wang | H01C 17/006 338/307 |
| 2014/0123989 | A1* | 5/2014 | LaMothe | A24F 47/008 131/328 |
| 2014/0253144 | A1 | 9/2014 | Novak, III et al. | |
| 2014/0270727 | A1 | 9/2014 | Ampolini et al. | |
| 2014/0338685 | A1 | 11/2014 | Amir | |
| 2015/0075545 | A1 | 3/2015 | Xiang | |
| 2015/0101625 | A1 | 4/2015 | Newton et al. | |
| 2015/0264979 | A1 | 9/2015 | Thorens et al. | |

FOREIGN PATENT DOCUMENTS

| | | | |
|---|---|---|---|
| WO | WO-2014/201432 | A1 | 12/2014 |
| WO | WO-2015/015431 | A1 | 2/2015 |
| WO | WO-2015/035674 | A1 | 3/2015 |

OTHER PUBLICATIONS

International Preliminary Report on Patentability dated May 22, 2018 in International Application No. PCT/EP2016/075861.

International Search Report and Written Opinion of the International Searching Authority dated Feb. 8, 2017 in International application No. PCT/EP2016/075861.

* cited by examiner

CARTRIDGE FOR AN AEROSOL-GENERATING SYSTEM WITH CUSTOMIZABLE IDENTIFICATION RESISTANCE

CROSS-REFERENCE TO RELATED APPLICATIONS

This application is a continuation of, and claims priority to, international application no. PCT/EP2016/075861, filed on Oct. 26, 2016, and further claims priority under 35 U.S.C. § 119 to European Patent Application No. 15194895.7, filed Nov. 17, 2015, the entire contents of each of which are incorporated herein by reference.

BACKGROUND

Field

One or more example embodiments relate to methods of manufacturing cartridges for aerosol-generating systems. In at least some example embodiments, the cartridges are provided with an electrical resistor having a customizable electrical resistance indicative of the aerosol-forming medium stored in the cartridge.

Description of Related Art

Electronic vaping (or e-vaping) devices have a modular construction and may include a replaceable cartridge with a storage component for holding an aerosol-forming substrate. The aerosol-forming substrate comprised in the cartridge may vary considerably in composition, flavour, strength or other characteristics. Adult vapers may wish to interchange cartridges at will. However, more optimum vaporization conditions may depend on the composition of the aerosol-forming substrate included in the cartridges. By identifying the replaceable cartridge or the aerosol-forming substrate stored in the cartridge, the control settings of the vaporization equipment may be changed to adapt the vaporization unit to the particular or specific aerosol-forming substrate chosen by an adult vaper.

A replaceable cartridge of an aerosol generator may include one or more electrical components for distinguishing the cartridge from other cartridges. The electrical components may be one or more electrical resistors, capacitances or inductances. The aerosol generator may also be able to determine the electrical resistance of the one or more electrical components. The aerosol generator may further include a look-up table stored in a memory, and in which the characteristics of the electrical components are associated with data identifying the respective cartridge. In order to allow for distinguishing between different cartridges a plurality of electrical components may be used.

In a manufacturing method for the cartridge discussed above, the electrical components must be provided to the cartridges during assembly, and before the cartridges are tilled with the aerosol-forming substrate. Thus, the electrical components must be determined and/or predefined prior to or during the assembly stage, and before the respective aerosol-forming substrate is provided to the cartridge. This sequential manufacturing method may reduce flexibility of the cartridge production process. Additionally, a number of different electrical components (e.g., a number of different resistors) must be provided to equip the plurality of cartridges with their particular or specific and unambiguous combination of resistors during assembly, which may increase manufacturing costs.

SUMMARY

One or more example embodiments may simplify and/or increase flexibility of cartridge manufacturing processes.

For example, one or more example embodiments may simplify production and/or manufacture of cartridges for aerosol-generating systems (also referred to as electronic vaping or e-vaping systems/devices), as each cartridge may be initially provided with an identical customizable basic resistor having a basic initial resistance. Thus, only one type of resistor is required as a basis, in order to produce a plurality of cartridges, wherein each type of cartridge or each type of aerosol-forming substrate (also referred to as a pre-vapor formulation substrate) included in the cartridge is defined by an individual resistance value.

At least one example embodiment provides a method of manufacturing a cartridge of an electronic vaping device having a pre-vapor formulation storage element, the method comprising: physically manipulating an electrical resistor to change a resistance of the electrical resistor from a first resistance value to a second resistance value, the second resistance value indicative of a pre-vapor formulation substrate contained in the pre-vapor formulation storage element; and mounting the electrical resistor to a portion of the cartridge.

According to one or more example embodiments, the electrical resistance of the electrical resistor is customized by physical manipulation, such that the resulting value of the electrical resistance is indicative of the pre-vapor formulation substrate in the pre-vapor formulation storage element.

Throughout this document the terms resistor, electrical resistor, or basic resistor may be used synonymously. The term basic resistor is used when it is desired to emphasize that the resistor is not yet customized.

The electrical resistor may be made from any suitable material. For example, the electrical resistor may be composed of materials that may be modified relatively easily, such as a metallic sheet material made from Nichrome, aluminum, copper or similar materials. The resistor may also be made from tungsten.

According to at least some example embodiments, Nichrome may be used because the material may be manipulated relatively easily, has relatively high resistivity, and is resistant to oxidation even at relatively high temperatures. When materials that have lower resistivity are used, the dimensions of the resistors may still be selected to produce measurable differences in resistance when customized. The material may also be covered by a suitable covering layer in order to reduce exposure to air and oxidation.

The basic resistor provided to each cartridge may also have any suitable shape. The basic resistor may initially have a given (or, alternatively, desired or predefined) geometrical shape, such as a rectangular, circular, semi-circular shape or any suitable combination thereof.

The material of the basic resistor may be modified relatively easily (e.g., through physical manipulation, such as piercing, clipping, puncturing, cutting, stamping, deforming or a combination thereof). Of course, the skilled person will readily appreciate that further methods may be suitable to modify the basic resistor. For example, material may be added to the basic resistor in order to customize its resistance. The additional material may be adjoined to the basic resistor by crimping, stamping, pressing, etc. It is further possible to customize the basic resistor by printing a metal layer thereon using suitable stamping or painting techniques. The resistance may also be modified by applying a given (or, alternatively, desired or predefined) amount of molten metal to its surface. Here, in particular, relatively low melting metallic materials such as solder material may be used.

It is understood that the skilled person may also combine one or more customization techniques in order to modify and adjust the resistance of the basic resistor.

The electrical resistor may be mounted to the cartridge at any suitable position. For example, the electrical resistor may be mounted on the inside of the cartridge, such that the resistor is not accessible by an adult vaper during normal replacement handling of the cartridge.

The electrical resistor may also be mounted on the outside of the cartridge, for example, on an end face of the cartridge. By providing the electrical resistor on the outside of the cartridge, it is possible to customize the basic resistor at any time after the cartridge manufacturing process. Thus, manufacturing of the cartridge and customization of the basic resistor may be performed at different geographic locations and/or at different times. In one example, customization may be performed at the filling location, immediately and/or directly before or after the cartridge is filled.

During manufacture, each cartridge may have an identical construction, independent from the actual type of aerosol-forming substrate to be included therein. This facilitates logistics during manufacture because it is not necessary anymore to precisely define the exact numbers of each individual type of cartridges upon their manufacture. Instead, during manufacture all cartridges are equally provided with the same customizable basic resistor. The decision as to which cartridge has to be provided with which resistance is postponed until a decision is made regarding which aerosol-forming substrate is filled into the respective cartridge. Thus, the overall production mode is even more efficient because only a single type of cartridges is provided to the filling location, and the cartridges may then be customized to be provided with varying resistances after the decision is made which cartridge is filled with which aerosol-forming substrate.

In order to further protect the resistor from unwanted and/or inadvertent manipulation, the cartridge may be provided with a cap configured to cover the electrical resistor. In this way the electrical resistance is accessible for intentional customization, but is protected from manipulation, which improves safety for the adult vaper.

The cartridge may also comprise a heater element, which is connected to a power source, and is controlled by the electric circuitry (also referred to as electronic circuitry or electronic control circuitry) of the aerosol-generating system. Electrical contacts for connecting the electric heater and the electric resistor to the control circuitry may be provided as point contacts, rectangular contacts, circular contacts, or as concentric ring contacts. Smaller contact areas allow for a more compact construction, but may require that the cartridge resumes a particular or specific orientation in order to close the contact. In contrast thereto, larger contact areas (e.g., ring contacts) may not require a particular or specific orientation of the cartridge, and therefore may simplify handling of the system for adult vapers.

At least one other example embodiment provides a cartridge of an electronic vaping device, the cartridge comprising: a pre-vapor formulation storage element containing a pre-vapor formulation substrate; and an electrical resistor mounted to a portion of the cartridge, the electrical resistor having a customized resistance value indicative of the pre-vapor formulation substrate contained in the pre-vapor formulation storage element, the customized resistance value obtained via physical manipulation of the electrical resistor, and the customized resistance value being different from an initial resistance of the electrical resistor prior to the physical manipulation.

As mentioned above, the electrical resistor may be customizable by physical manipulation, such that the resulting value of the electrical resistance is indicative of the pre-vapor formulation substrate included in the pre-vapor formulation storage element.

At least one other example embodiment provides an electronic vaping device comprising: a cartridge and a control section. The cartridge includes: a pre-vapor formulation storage element containing a pre-vapor formulation substrate; and an electrical resistor mounted to a portion of the cartridge, the electrical resistor having a customized resistance value indicative of the pre-vapor formulation substrate contained in the pre-vapor formulation storage element, the customized resistance value obtained via physical manipulation of the electrical resistor, and the customized resistance value being different from an initial resistance of the electrical resistor prior to the physical manipulation. The control section includes electronic control circuitry configured to determine the customized resistance value of the electrical resistor, and to associate the customized resistance value with data identifying the cartridge to identify a type of the pre-vapor formulation substrate contained in the pre-vapor formulation storage element.

The cartridge may be detachably coupled to the control section.

The control section may further include a memory device storing a look-up table, the look-up table including data indicative of electrical resistances of the customized resistors, wherein each electrical resistance value is associated with data identifying a cartridge.

The look-up table may further comprise data representing one or more resistance values, wherein each resistance value is further associated with parameters representing a different energy profile to be applied to the heating element. Each resistance value may also be associated with a different cartridge identifier, such that the electronic vaping device may be configured to deliver a constant or substantially constant amount (e.g., volume or mass) of vapor to an adult vaper even when cartridges containing different pre-vapor formulation substrates are inserted into the electronic vaping device.

For example, a particular pre-vapor formulation substrate contained within one cartridge may require more energy to be vaporized, than a different pre-vapor formulation substrate contained within another cartridge. By associating a resistance value or a particular cartridge identifier with a heating profile stored in a look-up table, a constant or substantially constant amount of vapor may be delivered to the adult vaper independent of the type of pre-vapor formulation substrate stored in the cartridge.

BRIEF DESCRIPTION OF THE DRAWINGS

Example embodiments will be further described, by way of example only, with reference to the accompanying drawings in which.

DETAILED DESCRIPTION

Figures 1A, 1B, 1C, 1D:
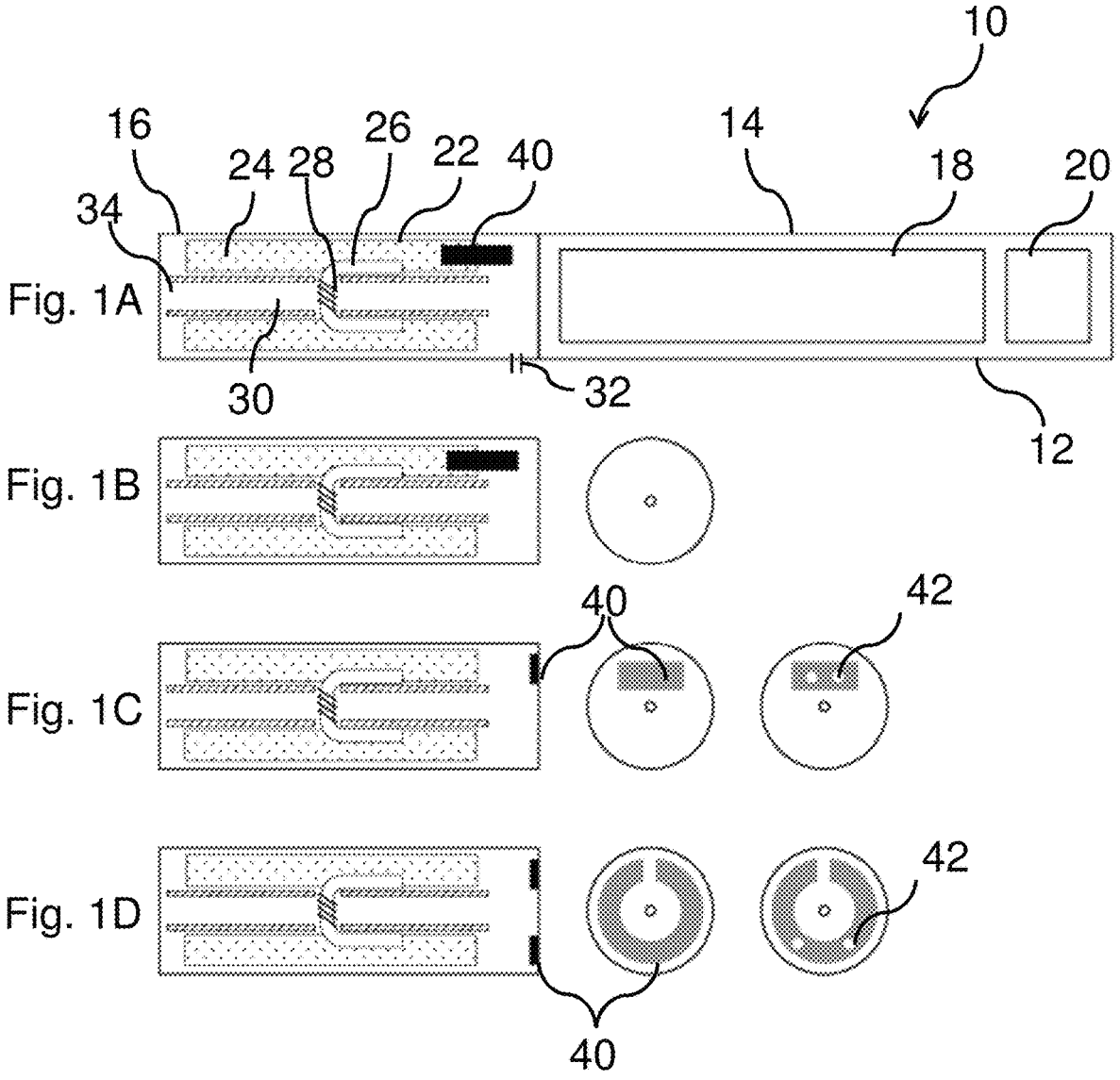
FIG. 1A illustrates an aerosol generating system according to an example embodiment.
FIGS. 1B through 1D illustrate cartridges having resistors mounted thereto, according to example embodiments.

Example embodiments will become more readily understood by reference to the following detailed description of the accompanying drawings. Example embodiments may, however, be embodied in many different forms and should not be construed as being limited to the example embodiments set forth herein. Rather, these example embodiments are provided so that this disclosure will be thorough and complete. Like reference numerals refer to like elements throughout the specification.

The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the terms "comprises," "comprising," "includes," and/or "including," when used in this specification, specify the presence of stated features, integers, steps, operations, elements, and/or components, but do not preclude the presence or addition of one or more other features, integers, steps, operations, elements, components, and/or groups thereof.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on", "directly connected to" or "directly coupled to" another element or layer, there are no intervening elements or layers present. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings set forth herein.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Example embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, these example embodiments should not be construed as limited to the particular shapes of regions illustrated herein, but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of this disclosure.

Unless otherwise defined, all terms (including technical and scientific terms) used herein have the same meaning as commonly understood by one of ordinary skill in the art. It will be further understood that terms, such as those defined in commonly used dictionaries, should be interpreted as having a meaning that is consistent with their meaning in the context of the relevant art and this specification and will not be interpreted in an idealized or overly formal sense unless expressly so defined herein.

Unless specifically stated otherwise, or as is apparent from the discussion, terms such as "processing" or "computing" or "calculating" or "determining" or "displaying" or the like, refer to the action and processes of a computer system, or similar electronic computing device, that manipulates and transforms data represented as physical, electronic quantities within the computer system's registers and memories into other data similarly represented as physical quantities within the computer system memories or registers or other such information storage, transmission or display devices.

In the following description, illustrative embodiments may be described with reference to acts and symbolic representations of operations (e.g., in the form of flow charts, flow diagrams, data flow diagrams, structure diagrams, block diagrams, etc.) that may be implemented as program modules or functional processes including routines, programs, objects, components, data structures, etc., that perform particular tasks or implement particular abstract data types. The operations be implemented using existing hardware in existing electronic systems, such as one or more microprocessors, Central Processing Units (CPUs), digital signal processors (DSPs), application-specific-integrated-circuits (ASICs), SoCs, field programmable gate arrays (FPGAs), computers, or the like.

Further, one or more example embodiments may be (or include) hardware, firmware, hardware executing software, or any combination thereof. Such hardware may include one or more microprocessors, CPUs, SoCs, DSPs, ASICs, FPGAs, computers, or the like, configured as special purpose machines to perform the functions described herein as well as any other well-known functions of these elements. In at least some cases, CPUs, SoCs, DSPs, ASICs and FPGAs may generally be referred to as processing circuits, processors and/or microprocessors.

Although processes may be described with regard to sequential operations, many of the operations may be performed in parallel, concurrently or simultaneously. In addition, the order of the operations may be re-arranged. A process may be terminated when its operations are completed, but may also have additional steps not included in the figure. A process may correspond to a method, function, procedure, subroutine, subprogram, etc. When a process corresponds to a function, its termination may correspond to a return of the function to the calling function or the main function.

As disclosed herein, the term "storage medium", "computer readable storage medium" or "non-transitory computer readable storage medium," may represent one or more devices for storing data, including read only memory (ROM), random access memory (RAM), magnetic RAM, core memory, magnetic disk storage mediums, optical storage mediums, flash memory devices and/or other tangible machine readable mediums for storing information. The term "computer-readable medium" may include, but is not limited to, portable or fixed storage devices, optical storage devices, and various other mediums capable of storing, containing or carrying instruction(s) and/or data.

Furthermore, at least some portions of example embodiments may be implemented by hardware, software, firmware, middleware, microcode, hardware description languages, or any combination thereof. When implemented in software, firmware, middleware or microcode, the program code or code segments to perform the necessary tasks may be stored in a machine or computer readable medium such as a computer readable storage medium. When implemented in software, processor(s), processing circuit(s), or processing unit(s) may be programmed to perform the necessary tasks, thereby being transformed into special purpose processor(s) or computer(s).

A code segment may represent a procedure, function, subprogram, program, routine, subroutine, module, software package, class, or any combination of instructions, data structures or program statements. A code segment may be coupled to another code segment or a hardware circuit by passing and/or receiving information, data, arguments, parameters or memory contents. Information, arguments, parameters, data, etc. may be passed, forwarded, or transmitted via any suitable means including memory sharing, message passing, token passing, network transmission, etc.

FIG. 1A illustrates an example embodiment of an aerosol generating system (also referred to as an electronic vaping or e-vaping device/system) 10. The aerosol generating system 10 of FIG. 1 is an electrically heated aerosol generating system 10 and comprises a two-part housing 12 having a device portion (also referred to as a control section or power supply section) 14 and a cartridge 16. In the device portion 14, there is provided an electric power supply in the form of a battery 18 and an electric control circuitry (also referred to as electronic circuitry or electronic control circuitry) 20. The cartridge 16 comprises a liquid storage portion (also referred to as a pre-vapor formulation storage element) 22 containing aerosol-forming substrate (also referred to as a pre-vapor formulation or pre-vapor formulation substrate) 24, a capillary wick 26 and a heating element in the form of a heating coil 28. In this example embodiment the liquid storage portion 22 is a cylindrical structure defining a central air flow channel 30. The ends of the capillary wick 26 extend into the liquid storage portion 22. A central portion of the capillary wick 26 extends through the air flow channel 30 and is at least partially surrounded by the heating coil 28. The heating coil 28 is connected to the electric circuitry 20 via appropriate electrical connections (not shown). The housing 12 also includes an air inlet 32, and an air outlet 34 at the mouth-end piece.

During vaping, liquid aerosol-forming substrate 24 is transferred by capillary action from the liquid storage portion 22 from the ends of the wick 26, which extend into the liquid storage portion 22, to the central portion of the wick 26, which is surrounded by the heating coil 28. When an adult vaper applies negative pressure to the air outlet 34 at the mouth-end piece, ambient air is drawn through the air inlet 32. A detection system or puff detection system (not shown) senses application of negative pressure or application of negative pressure above a threshold (hereinafter collectively referred to as application of negative pressure) and activates the heating coil 28. Application of negative pressure and/or application of negative pressure above a threshold may also be referred to as a puff. The battery 18 supplies electrical energy to the heating coil 28 to heat the central portion of the wick 26 surrounded by the heating coil 28. The aerosol-forming substrate 24 in the central portion of the wick 26 is vaporized by the heating coil 28 to create a supersaturated vapor. The supersaturated vapor is mixed with and carried in the air flow from the air inlet 32. In the air flow channel 30 the vapor condenses to form an inhalable aerosol, which is carried towards and drawn through the outlet 34.

In addition to the above described elements, a customizable resistor 40 is mounted to the cartridge 16. The customizable resistor 40 is connected to the control circuitry 20 and allows the control circuitry 20 to identify the liquid storage portion 22, for example, the type of aerosol-forming substrate 24 in the liquid storage portion 22.

As indicated in FIGS. 1B to 1D the customizable resistor 40 may be placed at various positions of the cartridge 16.

In FIG. 1B the customizable resistor 40 is placed in the liquid storage portion 22. In this example embodiment, the resistor 40 is not visible to the adult vaper and is protected from damage during normal handling of the aerosol generating system 10. However, in this example embodiment customization is carried out during assembly of the cartridge 16.

In the example embodiments of FIGS. 1C and 1D the customizable resistor 40 is provided at the end face of the cartridge 16 that is connectable to the device portion 14 of the aerosol generating system 10. In at least this example embodiment the resistor 40 is still accessible after assembly of the cartridge 16. Thus, the resistor 40 may be customized at any time, and need not be customized at the assembly stage. Instead, the resistor 40 may be customized after the cartridge 16 is filled with aerosol-forming substrate 24. When the cartridge 16 is connected to the device portion 14, the resistor 40 is not visible to an adult vaper. Thus, under normal handling conditions, the resistor 40 is protected from accidental damage during vaping.

The customizable resistor 40 may take on various shapes. In FIGS. 1B and 1C, the resistor has a rectangular sheet-like shape. In FIG. 1D, the resistor has a largely circular shape. At the right hand sides of FIGS. 1C and 1D the resistor 40 is depicted before customization (without holes 42) and after customization (with holes 42).

Example embodiments of the aerosol generating system 10 and cartridges depicted in FIGS. 1A through 1D are only examples. The skilled person will readily appreciate that the identification system may also be used with other suitable designs of aerosol-generating systems 10 employing replaceable cartridges 16.

Figure 2:
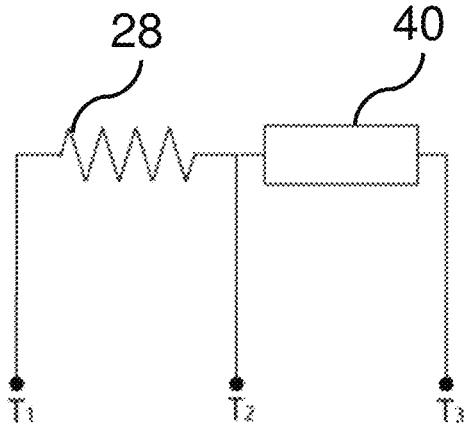
FIG. 2 shows an electronic circuit diagram for controlling the heater device and identifying the cartridge, according to an example embodiment.

FIG. 2 illustrates an electrical circuit diagram for controlling the heater device and identifying the cartridge, according to an example embodiment. In this example embodiment, the heating device (e.g., heating coil 28) is connected to two electrical contacts T1 and T2, which in turn are connected to two contacts of the power source (not shown) provided in the aerosol generating system.

In addition, the circuit diagram of FIG. 2 shows a further electronic contact T3. The customizable resistor 40 is provided between contacts T2 and T3. The control circuitry 20 of the aerosol generating system 10 is configured to determine the value of the customisable resistor 40 as discussed below.

As is known to those skilled in the art, the voltage drop V across a resistor of resistance R is proportional to the product of the resistance R and the current I flowing through the resistor R (V=IR). By measuring the magnitude or size of the electrical current passing through the resistor R for a given potential difference applied across resistor R, control circuitry is able to determine the value of the resistor R using the relationship R=V/I.

Having determined the value of resistor R associated with the cartridge, the control circuitry determines the cartridge type from the determined resistance value by searching a look-up table using the determined resistance value.

The look-up table may comprise one or more different resistance values, each resistance value associated with an identifier of a cartridge, which may be used with the aerosol generating system. The identifier may be indicative of the type of liquid (or pre-vapor formulation) contained within the cartridge.

The control circuitry may determine the type of cartridge as the cartridge identifier associated with the stored resistance value, which is closest in value to the cartridge resistance value determined by the control circuitry. The look-up table may be stored in a memory (e.g., a read only memory (ROM)) incorporated into the control circuitry, or may be stored in a separate memory.

FIGS. 3A through 3D show an example embodiment in which the basic resistor is provided with a central slit of fixed width and varying length.

In the example embodiment shown in FIGS. 3A through 3D, the basic resistor 40 is a rectangular bar made from Nichrome, which is a material commonly used for resistors. Nichrome has an electrical resistivity of between about 1 and about $1.5\times10^{-6}$ Ohms per meter. In the following calculations Nichrome is assumed to have an electrical resistivity of $1\times10^{-6}$. The Nichrome bar has a length L of 10 millimeters, a thickness T of 1 millimeter and a width W of 3 millimeters. Thickness T and width W define a cross-sectional area A of the bar of 3 square-millimeters. The resistance of the basic bar can be determined from its geometrical dimensions and the electrical resistivity according to formula (1) shown below.

$$R = \rho\frac{L}{A} \tag{1}$$

Figure 3A:
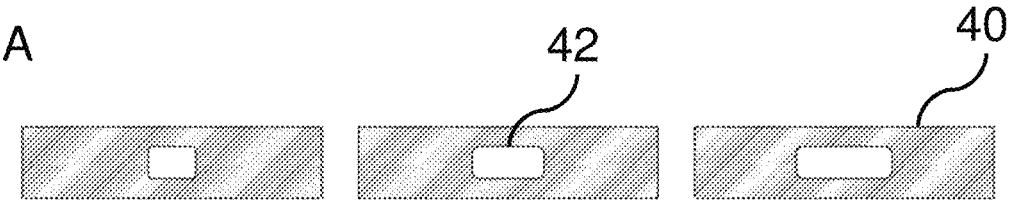
FIGS. 3A through 3D show an example embodiment in which the basic resistor is provided with a central slit of fixed width and varying length.
Figure 3B:
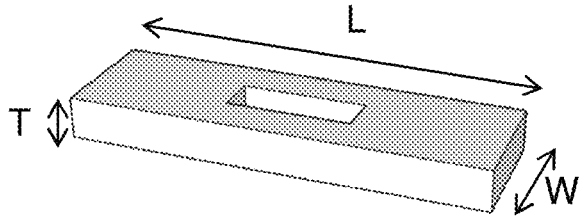
Figure 3C:
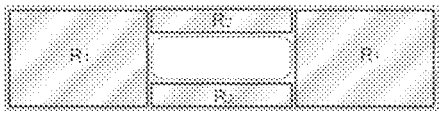
Figure 3D:
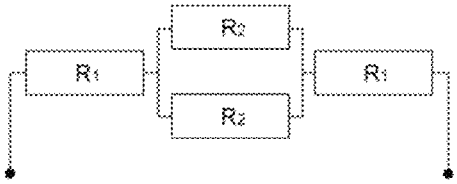

Accordingly the resistance of the basic customizable resistor 40 amounts to 3.33 Ohms. Nichrome may be relatively easily cut and/or punctured. As depicted in FIGS. 3A and 3B, the total resistance of the Nichrome bar can therefore be changed by cutting a hole 42 in the bar. In the example embodiment of FIGS. 3A through 3D, a hole or slit 42 having a width of 1 millimeter is provided in the center of the rectangular bar. The width of this hole 42 may be kept constant, while the length of the hole 42 is varied. In this way, a wider range of different resistance values may be obtained. The resulting resistances may be calculated by approximating the customized resistor 40 as being assembled from a plurality of individual resistors $R_1$ and $R_2$ as depicted in FIG. 3C, which correspond to the equivalent circuit diagram depicted in FIG. 3D. In this example, the cross-sectional area of the resistors $R_2$ amounts to about 1 square-millimeter.

Using known formulas for calculating the total resistance of serial or parallel connected resistors, the total resistance of the customized Nichrome bar may be calculated according to the following formulas:

$$R = R_1 + R_{2tot} + R_1$$

$$R_{2tot} = \frac{1}{\frac{1}{R_2} + \frac{1}{R_2}} = \frac{R_2}{2}$$

$$R_1 = \rho\frac{L_1}{A_1};\quad R_2 = \rho\frac{L_2}{A_2}$$

$$\Rightarrow R = 2R_1 + \frac{R_2}{2} = \rho\left(2\frac{L_1}{A_1} + \frac{L_2}{2A_2}\right)$$

The resulting total resistance values of the customized bar being provided with a hole 42 having a constant width of about 1 millimeter and a varying length of between about 0 and about 4 millimeters is given in the following table:

TABLE 1

Resistor values for slits with varying length

| $L_1$ (millimeters) | $L_2$ (millimeters) | $R_1$ (milliohms) | $R_2$ (milliohms) | $R_{tot}$ (milliohms) |
|---|---|---|---|---|
| 5.0 | 0 | 1.67 | 0 | 3.33 |
| 4.5 | 1.0 | 1.50 | 1.0 | 3.50 |
| 4 | 2.0 | 1.33 | 2.0 | 3.67 |
| 3.5 | 3.0 | 1.17 | 3.0 | 3.83 |
| 3.0 | 4.0 | 1.0 | 4.0 | 4.00 |

Reproducing the holes exactly may enable the electronic circuit to more reliably distinguish between the resistance values. The accuracy of the method for forming the hole in this case may be greater than or equal to about +/−5%.

As the rectangular bar is made from Nichrome material, the shape of the bar may be relatively easily be modified mechanically. In the example embodiment shown in FIGS. 3A through 3D the hole may be punctured into the material by a suitable tool comprising a variety of punching bits for forming holes 42 of varying length. Customization of the resistor 40, which according to at least some example embodiments may be a plain or basic resistor bar, may be performed at any time during manufacture of the cartridge 16. Customization may be performed after the decision is made which aerosol-forming substrate 24 is to be filled into the cartridge 16. Thus, customization may be made after the aerosol-forming substrate is filled into the cartridge 16.

The electronic control circuit 20 determines the resistance value in order to verify the type of cartridge 16, and thus, the type of the aerosol-forming substrate 24 provided in the currently inserted cartridge 16. Having determined the type of the aerosol-forming substrate 24, the electronic control circuitry 20 may adjust the settings for activation of the heater device 28 to the particular or specific type of aerosol-forming substrate 24. In this way, more optimum vaporization conditions may be achieved for a wider variety of aerosol-forming substrates 24 usable with the aerosol generation system 10.

FIGS. 4A through 4E show other example embodiments in which the basic resistor is provided with central recesses of fixed length and varying width.

Figure 4A:
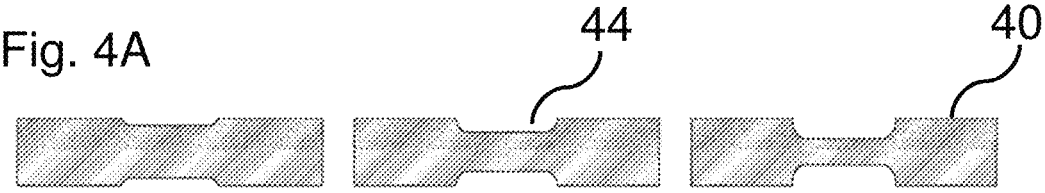
FIGS. 4A through 4E show other example embodiments in which the basic resistor is provided with central recesses of fixed length and varying width.
Figure 4B:
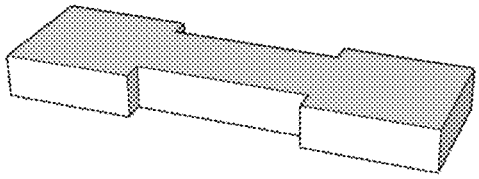
Figure 4E:
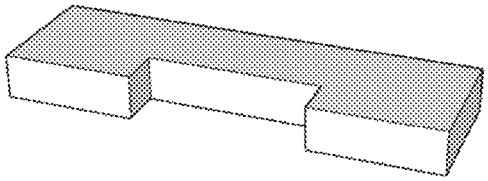
Figure 4C:
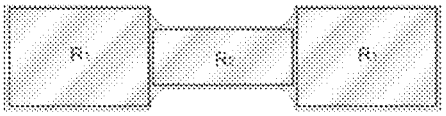
Figure 4D:
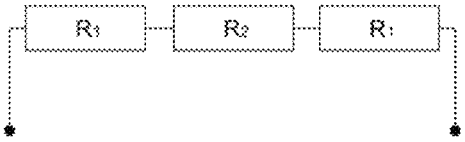

In the example embodiment shown in FIGS. 4A through 4D, the basic resistor 40 is again a rectangular bar made from Nichrome, having the same or substantially the same basic dimensions as the Nichrome bar illustrated in FIGS. 3A through 3D. In the example embodiment of FIGS. 4A through 4D, two lateral recesses 44 are provided at the centers of the longitudinal edges of the rectangular bar. In this case, the length of the recesses 44 is about 4 millimeters and is kept constant or substantially constant, while the depth of the recesses 44 is varied. In this way, a wider range of different resistance values may be obtained. The resulting resistances may be calculated by approximating the customized resistor 40 as being assembled from three serially connected resistors $R_1$, $R_2$, $R_1$, as depicted in FIG. 4C, which corresponds to the equivalent circuit diagram as depicted in FIG. 4D.

Using the above discussed formulas for calculating the total resistance of serially connected resistors, the resulting total resistance values of the customized bar being provided with recesses 44 having a constant length of about 4 millimeters and a varying depth of between about 0 and about 2 millimeters is given in the following table:

TABLE 2

Resistor values for recesses with varying depth

| $W_1$ (millimeters) | $W_2$ (millimeters) | $R_1$ (milliohms) | $R_2$ (milliohms) | $R_{tot}$ (milliohms) |
|---|---|---|---|---|
| 3.0 | 3.0 | 1.0 | 1.33 | 3.33 |
| 3.0 | 2.5 | 1.0 | 1.6 | 3.60 |
| 3.0 | 2.0 | 1.0 | 2.0 | 4.00 |
| 3.0 | 1.5 | 1.0 | 2.67 | 4.67 |
| 3.0 | 1.0 | 1.0 | 4.0 | 6.00 |

The same values are obtained if a single recess 44 with double depth is provided on one longitudinal edge of the customizable resistor, as depicted in FIG. 4E.

Again, the electronic control circuit 20 determines the resistance value in order to verify the type of cartridge 16. Based thereon, the electronic control circuitry 20 may adjust the settings for activation of the heater device 28 to the particular or specific type of aerosol-forming substrate 24 used with the aerosol generation system 10.

Example embodiments described above illustrate, but are not limiting. In view of the above discussed example embodiments, other embodiments consistent with the above example embodiments will be apparent to one of ordinary skill in the art. For example, in the example embodiment depicted in FIGS. 3A through 3D, the length of the hole may be kept constant or substantially constant while the width of the hole is varied in order to change the electrical resistance of the customizable resistor. Further, additional holes or recesses, combinations of holes and recesses, or holes and recesses having other than rectangular shape may be used.

What is claimed is:

1. An electronic vaping device comprising
a cartridge including
a pre-vapor formulation storage element containing a pre-vapor formulation substrate, and
an electrical resistor mounted to a portion of the cartridge, the electrical resistor having a customized resistance value indicative of the pre-vapor formulation substrate contained in the pre-vapor formulation storage element, the customized resistance value obtained via a physical manipulation of the electrical resistor, and the customized resistance value being different from an initial resistance of the electrical resistor prior to the physical manipulation; wherein
the electrical resistor has a first structure prior to the physical manipulation and a second structure after the physical manipulation,
the first structure is different from the second structure,
the initial resistance of the electrical resistor prior to the physical manipulation corresponds to the first structure, and
the customized resistance value of the electrical resistor corresponds to the second structure; and
a control section including
electronic control circuitry configured to
determine the customized resistance value of the electrical resistor, and
associate the customized resistance value with data identifying a type of the pre-vapor formulation substrate contained in the pre-vapor formulation storage element, and
a memory storing a look-up table, the look-up table including data indicative of electrical resistance values of a plurality of customized resistors, each electrical resistance value associated with data identifying a type of pre-vapor formulation substrate.

2. The electronic vaping device of claim 1, wherein the cartridge is detachably coupled to the control section.

3. The electronic vaping device of claim 2, wherein
an end of the cartridge is detachably coupled to an end of the control section; and
first electrical contacts at the end of the cartridge are electrically connected with the end of the electronic control circuitry in the control section.

4. The electronic vaping device of claim 3, wherein the first electrical contacts include at least one of point contacts, rectangular contacts, circular contacts, concentric ring contacts, a sub-combination thereof or a combination thereof.

5. The electronic vaping device of claim 2, wherein the cartridge further comprises:
a cap configured to cover the electrical resistor when the cartridge is detached from the control section.

6. The electronic vaping device of claim 1, wherein the cartridge further comprises:
at least one of point contacts, rectangular contacts, circular contacts, concentric ring contacts, a sub-combination thereof or a combination thereof.

7. The electronic vaping device of claim 1, further comprising:
electrical contacts at an end of the cartridge, the electrical contacts configured to electrically connect with the electronic control circuitry.

8. The electronic vaping device of claim 7, wherein the electrical contacts at the end of the cartridge include at least one of point contacts, rectangular contacts, circular contacts, concentric ring contacts, a sub-combination thereof or a combination thereof.

9. The electronic vaping device of claim 1, wherein the cartridge includes
a cap configured to cover the electrical resistor.

10. An electronic vaping device comprising
a cartridge including
a pre-vapor formulation storage element containing a pre-vapor formulation substrate, and
an electrical resistor mounted to a portion of the cartridge, the electrical resistor having a customized resistance value indicative of the pre-vapor formulation substrate contained in the pre-vapor formulation storage element, the customized resistance value obtained via a physical manipulation of the electrical resistor, and the customized resistance value being different from an initial resistance of the electrical resistor prior to the physical manipulation; wherein the electrical resistor has a first structure prior to the physical manipulation and a second structure after the physical manipulation, the first structure is different from the second structure, the initial resistance of the electrical resistor prior to the physical manipulation corresponds to the first structure, and the customized resistance value of the electrical resistor corresponds to the second structure; and a control section including electronic control circuitry configured to determine the customized resistance value of the electrical resistor, and associate the customized resistance value with data identifying the cartridge, and a memory storing a look-up table, the look-up table including data indicative of electrical resistance values of a plurality of customized resistors, each electrical resistance value associated with data identifying a cartridge.

* * * * *